US008776458B2

(12) United States Patent
Conterno

(10) Patent No.: US 8,776,458 B2
(45) Date of Patent: Jul. 15, 2014

(54) SKYLIGHT TO INTEGRATED IN A COVERING STRUCTURE MADE OF INSULATED SHEETS AND PRODUCTION METHOD THEREOF

(75) Inventor: Cosimo Conterno, Mendrisio (CH)

(73) Assignee: Politec Polimeri Tecnici S.A., Stabio (CH)

( * ) Notice: Subject to any disclaimer, the term of this patent is extended or adjusted under 35 U.S.C. 154(b) by 196 days.

(21) Appl. No.: 13/065,466

(22) Filed: Mar. 22, 2011

(65) Prior Publication Data

US 2011/0232215 A1 Sep. 29, 2011

(30) Foreign Application Priority Data

Mar. 23, 2010 (IT) ..... MI2010A0480

(51) Int. Cl.
*E04B 7/12* (2006.01)
*E04B 7/18* (2006.01)

(52) U.S. Cl.
USPC ..... 52/200; 52/18

(58) Field of Classification Search
USPC ..... 52/18, 171.1, 171.3, 200
See application file for complete search history.

(56) References Cited

U.S. PATENT DOCUMENTS

| | | | | |
|---|---|---|---|---|
| 2,844,998 | A * | 7/1958 | Vincent | 359/593 |
| 4,089,324 | A * | 5/1978 | Tjaden | 126/666 |
| 4,335,551 | A * | 6/1982 | Benkelman et al. | 52/200 |
| 5,966,888 | A * | 10/1999 | Richardson | 52/580 |
| 6,931,796 | B2 * | 8/2005 | Adriaansen et al. | 52/81.1 |
| 6,959,519 | B2 * | 11/2005 | Adriaansen | 52/537 |
| 7,992,361 | B2 * | 8/2011 | Thiagarajan et al. | 52/783.1 |
| 8,316,598 | B2 * | 11/2012 | Flynn et al. | 52/235 |
| 2003/0056448 | A1 * | 3/2003 | Givoni | 52/171.3 |
| 2004/0159054 | A1 * | 8/2004 | Adriaansen et al. | 52/81.1 |
| 2007/0251166 | A1 * | 11/2007 | Thiagarajan et al. | 52/177 |
| 2008/0113184 | A1 * | 5/2008 | Yoshida et al. | 428/332 |
| 2008/0187725 | A1 * | 8/2008 | Grandhee et al. | 428/195.1 |
| 2008/0190050 | A1 * | 8/2008 | McClure | 52/200 |
| 2008/0308226 | A1 * | 12/2008 | Imai et al. | 156/327 |
| 2009/0049771 | A1 * | 2/2009 | Konstantin | 52/200 |
| 2011/0048536 | A1 * | 3/2011 | Rivard et al. | 136/260 |

FOREIGN PATENT DOCUMENTS

| | | | |
|---|---|---|---|
| DE | 91 15 940 | U1 | 2/1992 |
| EP | 345 884 | A2 | 12/1989 |
| EP | 0 576 062 | A1 | 12/1993 |
| WO | WO01/34379 | A1 | 5/2001 |

OTHER PUBLICATIONS

Italian PCT Search Report dated Oct. 27, 2010.
Italian Search Report dated Oct. 27, 2010.

* cited by examiner

*Primary Examiner* — Ryan Kwiecinski
(74) *Attorney, Agent, or Firm* — Modiano & Partners; Daniel J. O'Byrne

(57) ABSTRACT

A skylight to be integrated in a covering structure made of insulated sheets comprises at least one top fretted panel (20) extruded in plastic material and at least one bottom alveolar panel (30) extruded in plastic material, firmly integrally joined by interposing a continuous or discontinuous layer, of adhesive material (40), wherein the layer of adhesive material (40) is prearranged on at least one of the top (20) and bottom (30) panels on a surface facing the opposite panel. A method for producing the skylight to be integrated in a covering structure with insulated panels is also part of the invention.

6 Claims, 5 Drawing Sheets

SKYLIGHT TO INTEGRATED IN A COVERING STRUCTURE MADE OF INSULATED SHEETS AND PRODUCTION METHOD THEREOF

The present invention refers to a skylight to be integrated in a covering structure made of insulated sheets and a production method thereof.

The expression covering structure made of insulated sheets is used to indicate a covering structure with insulated panels or with metal sheets coupled with insulating mattresses.

In a covering structure made of insulated sheets, providing skylights for the passage of light reveals serious technical drawbacks regarding water sealing and thermal insulation related both to the coupling between the skylight and the insulated sheets as well as to the structure of the skylight.

Generally, skylights are provided by arranging some insulated panels, or sheets, inclined with respect to the covering plane to form a vertical gap in which there is installed a frame which withholds the skylight.

An object of the present invention is that of providing a skylight to be integrated in a covering structure made of insulated sheets capable of overcoming the previously described technical drawbacks.

Another object of the present invention is that of providing a skylight to be integrated in a covering structure made of insulated sheets capable of allowing the entry of the highest amount of light possible.

A further object is that of providing a method for obtaining a skylight to be integrated in a covering structure made of insulated sheets, capable of allowing a simple storage as well as a quick and simple laying of the skylight on site.

Another object of the present invention is that of providing a skylight to be integrated in a covering structure made of insulated sheets that is particularly simple and functional, with low costs.

These objects according to the present invention are attained by providing a skylight to be integrated in a covering structure made of insulated sheets and a production method thereof as outlined in claim 1.

Further characteristics are provided for in the dependent claims.

Characteristics and advantages of a skylight to be integrated in a covering structure made of insulated sheets and a production method thereof according to the present invention shall be more apparent from the following exemplifying and non-limiting description with reference to the attached schematic drawings wherein.

Figure 4:
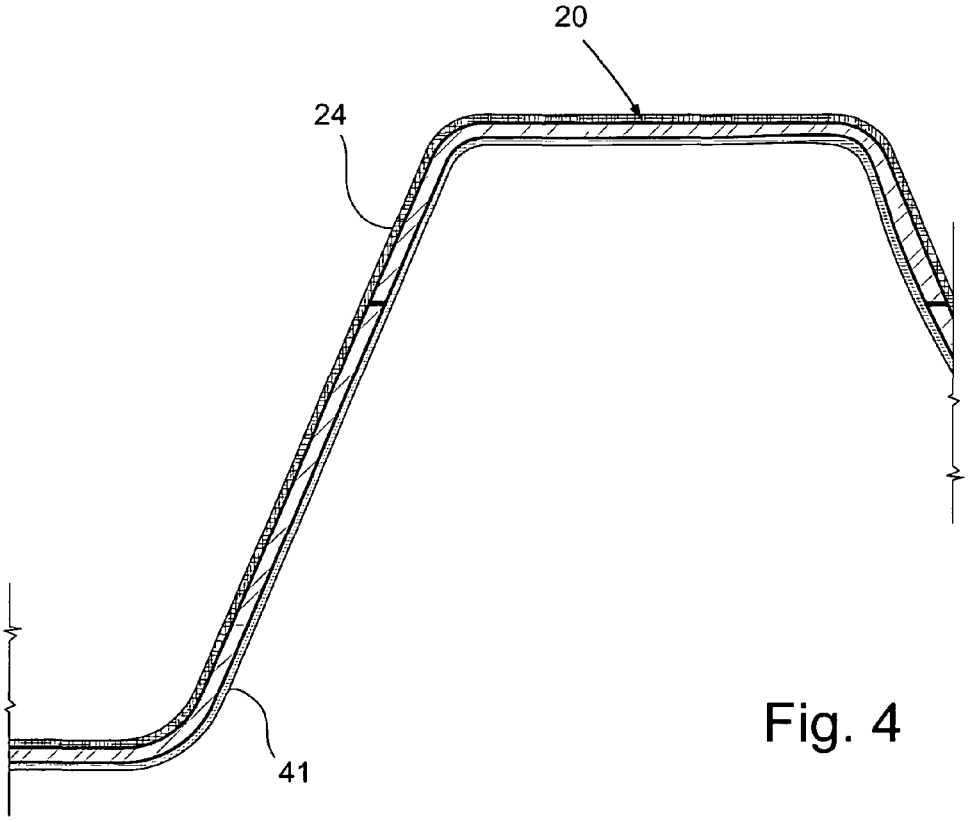

FIG. 4 schematically shows different lining layers coextruded on both sides of a top fretted panel made of polycarbonate material.

Figure 5:
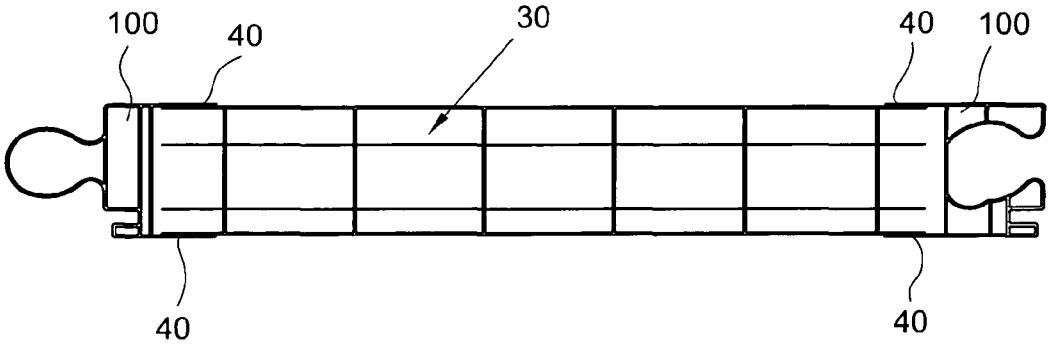

FIG. 5 shows an alveolar panel of the present invention having lateral profiles.

With reference to the figures, there is shown a skylight to be integrated in a covering structure made of insulated sheets, indicated in its entirety with 10, comprising a top fretted panel 20 made of plastic material and a bottom alveolar panel 30 preferably of the closed cells multi-alveolar type, made of plastic material, integrally and firmly joined by interposing a continuous or discontinuous layer of adhesive material 40 between the opposite surfaces of the two panels.

Preferably, the top fretted panel 20 and the bottom alveolar panel 30 are transparent and in such case, the joining between the adhesive material should maintain the transparency of the skylight 10.

In the present text the "length" of the skylight is measured in the direction parallel to the development of the frets 21 of the top panel 20, as well of the alveola 31 of the bottom panel 30, while the "width" is measured orthogonally to the length.

The top 20 and bottom 30 panels do not necessarily have the same width or length, it however being possible that for example a top fretted panel 20 be stably constrained through a layer of adhesive 40 with two bottom alveolar panels 30, or vice versa. Furthermore, the skylight 10, according to the invention, can in turn be constituted by several fretted top panels 20 and/or several bottom alveolar panels 30 coupled to each other at the ends to create a bigger light point.

Each skylight 10 can be coupled to adjacent fretted metal sheets of the covering structures made of insulated sheets, for example constituted by the insulated panels made of fretted sheet 11 or by the fretted metal sheets coupled with insulating mattresses. Coupling may occur in the direction of the width through lateral surmounting or in the direction of the length through head surmounting. This double coupling possibility is guaranteed if the profile of the top fretted panel 20 is complementary in the entire width thereof to the profile of the adjacent fretted metal sheet.

Figure 1:
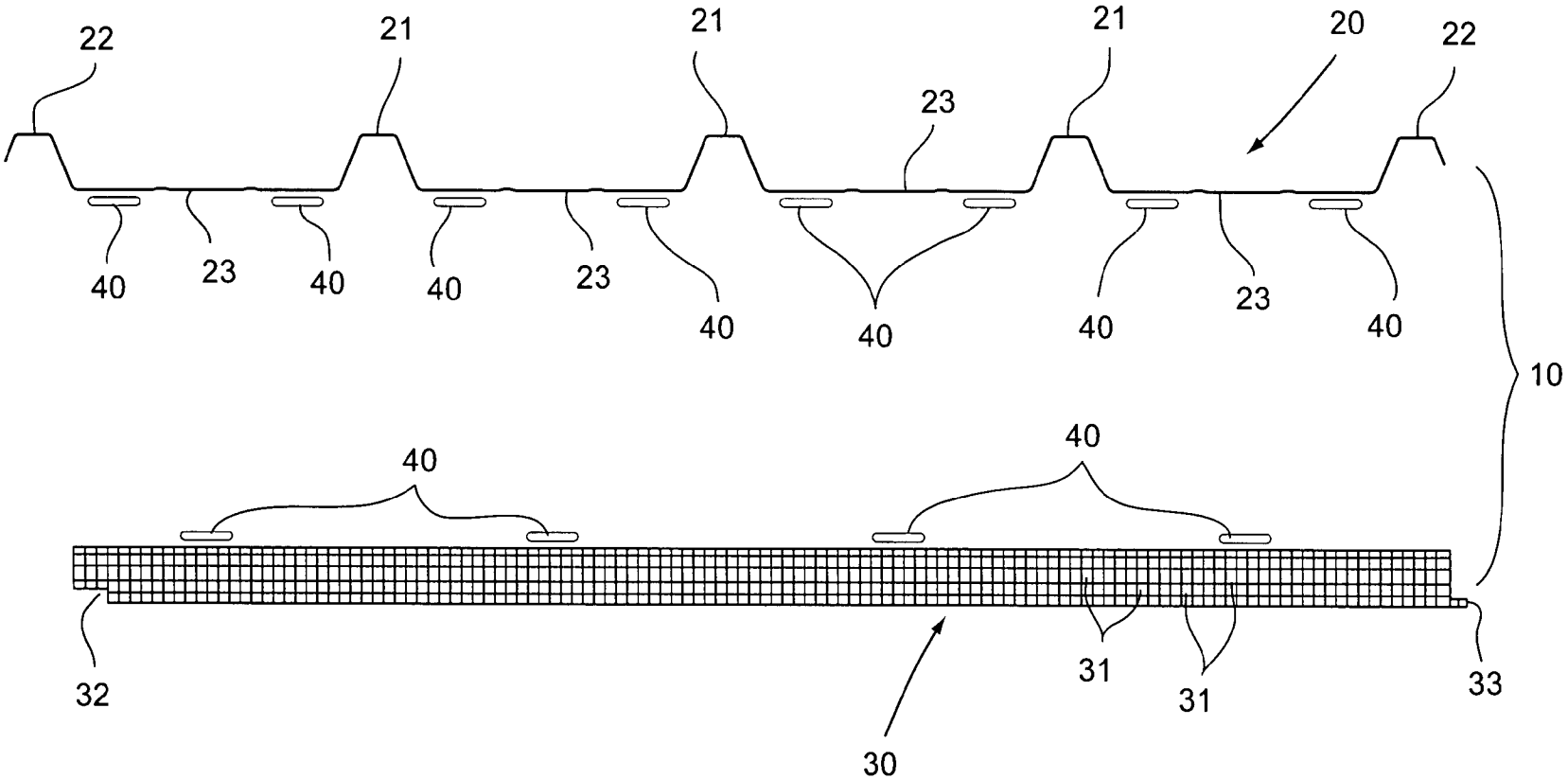
FIG. 1 is an exploded view of a skylight to be integrated in a covering structure made of insulated sheets according to the invention.
Figure 2A:
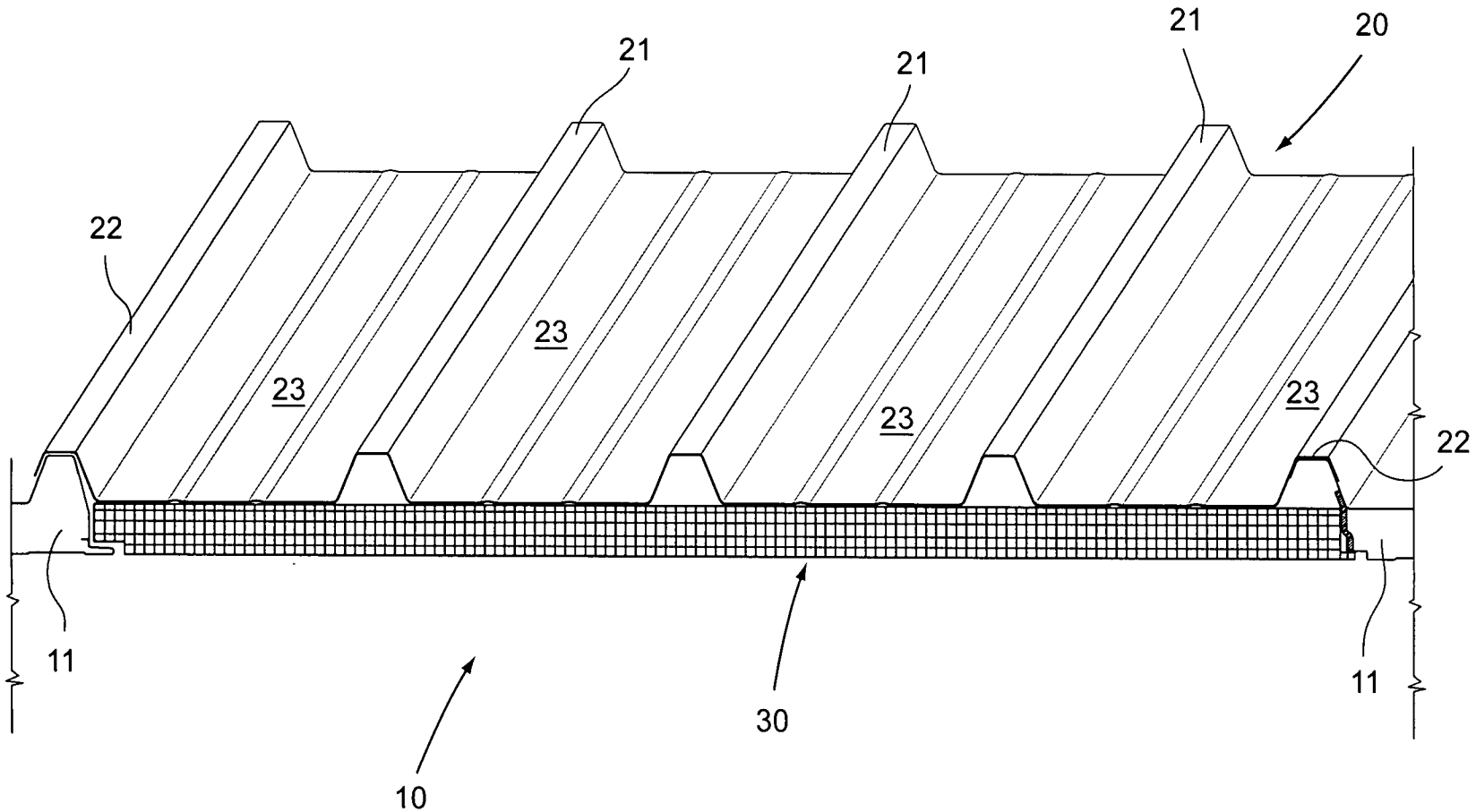
FIG. 2A is a schematic perspective view of a skylight integrated by lateral surmounting in a covering structure made of insulated sheets.

The top fretted panel 20 terminates at the opposite ends, in the direction of the width, with a coupling profile 22 complementary and which can be superimposed both at the bottom and at the top with adjacent fretted sheets, so as to guarantee lateral surmounting (FIG. 2A).

In the example shown in the figures, the coupling profile 22 defines an isosceles trapezium without the base, in which the oblique sides are arranged mirror-like and in which the outer side is shorter than the inner side.

Figure 2B:
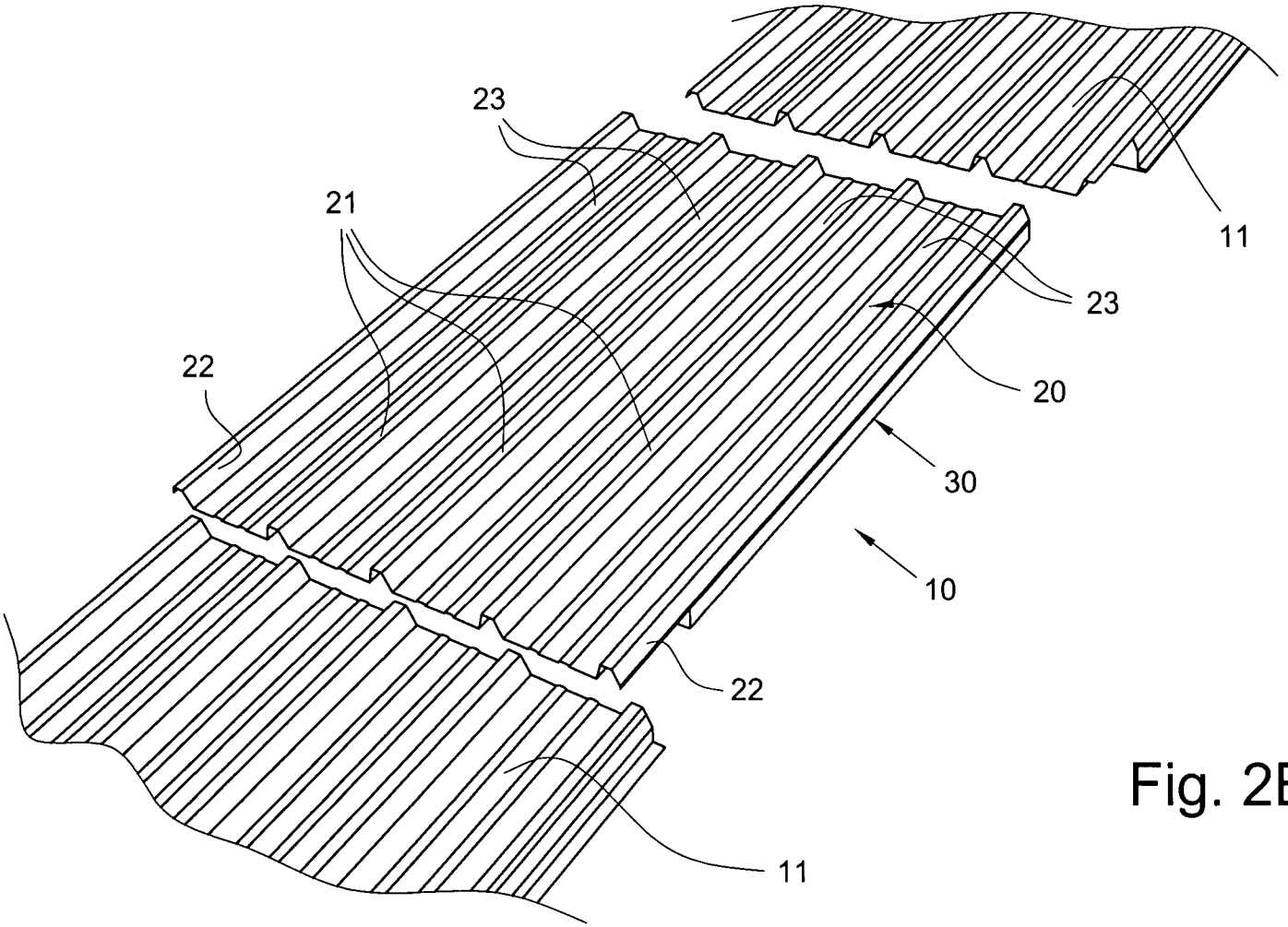
FIG. 2B is a schematic perspective view of a skylight integrated by head surmounting in a covering structure made of insulated sheets.
Figure 3:
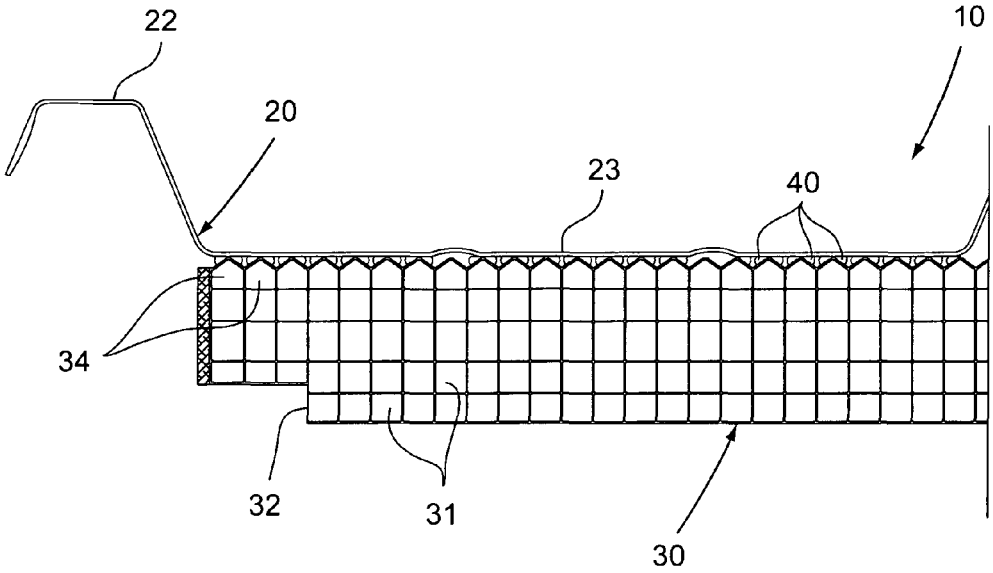
FIG. 3 shows an enlarged detail of a further embodiment of a skylight to be integrated in a covering structure made of insulated sheets according to the invention, provided with a bottom alveolar panel provided with a knurled surface facing the top fretted panel.

In order to provide the head surmounting (FIG. 2B) between the skylight 10 and the adjacent covering structure made of insulated sheets, the top fretted panel 20 should be longer with respect to the bottom alveolar panel 30, so as to head-surmount a section of the fretted sheet adjacent to an end. At the opposite end instead there is the adjacent fretted sheet for head-surmounting the top fretted panel 20.

The bottom panel 30 is a flat alveolar panel with thickness generally comprised between 30 mm and 60 mm. Any other thicknesses or any other alveolar structures different from the shown one fall within the scope of the invention.

Preferably, the bottom alveolar panel 30 bears at the opposite ends, in the direction of the width, respectively a recessed seat 32 and a projecting edge 33, extended over the entire length of the bottom alveolar panel 30, to allow the lateral mutual surmounting and the coupling with a bottom side of the insulated panel 11 or with another bottom alveolar panel 30 of the skylight 10 according to the invention.

According to a further embodiment, the bottom alveolar panel 30 may be knurled on the surface facing the top fretted panel 20, comprising a succession of triangular-shaped cusps 34.

In this case, the contact and the joining occur between substantially flat bases 23 of the top fretted panel 20, arranged between two successive frets 21 and the cusps 34 of the knurled surface profile of the bottom alveolar panel 30.

According to this embodiment, the layer of adhesive material 40 shall simultaneously guarantee a perfect sealing against air and water.

The further advantage of a knurled top surface lies in the presence, between one cusp 34 and the other, of a free channel which shall be used for draining possible infiltrations and/or condensates damaging the sealing of the gluing.

According to the present invention, the top 20 and bottom 30 panels are both obtained by extrusion, according to the known methods, separate from each other.

In particular, according to the preferred embodiment of the invention in which the skylight is transparent, the top fretted panel 20 is made of polycarbonate (PC) or polymethylmethacrylate (PMMA) and the bottom alveolar panel 30 is made of polycarbonate (PC).

Alternatively, according to the invention, the top 20 and bottom 30 panels can be obtained through extrusion of opaque plastic material, such as for example filled, foamed, painted or coated material, if there is any need to screen part or the entire gap.

In order to improve the adhesion between the components, the polycarbonate or PMMA surfaces that shall be at contact with the opposite panel can be lined with a surface layer 41, generally measuring a few tens of microns, made of a polar polymer material. The lined panel can be obtained by co-extrusion of the polymeric material forming the surface layer 41 on the polycarbonate panel or obtained through polymerisation of oligomers with UV systems, by means of heat or other radiation systems deposited of the surface. In the present description, the expression "co-extrusion" is used to indicate the formation of a layer of material on the surface of a second material, obtained through simultaneous extrusion.

In order to guarantee a good anchorage to the surface of the PC and/or PMMA, the polar polymeric material which forms the surface layer 41 is a material having chemical composition compatible with that of the PC or of the PMMA. For example, the above-mentioned polar polymeric material is selected from among those belonging to the following families: polyesters, polyurethanes, caprolactone polymers, acrylic polymers, acrylonitrile and silane. Preferably, the abovementioned polymeric material is polyethylene terephtalate (PET).

The presence of the surface layer 41 enhances the coupling performance for some adhesion techniques maintaining the mechanical, structural and chemical properties of the polycarbonate panel entirely unaltered.

The layer of adhesive material 40, intended to provide the firm joint between the top fretted panel 20 and the bottom alveolar panel 30, should be maintained structurally whole over time and even under pressure, for example when the skylight 10 is subjected to the action of snow and wind.

Furthermore, the state of adhesive material 40 should maintain the transparency of the skylight and not alter the properties of a possible outer protection layer 24, for example against UV rays, coextruded on the outer face of the fretted panel 20 in any manner whatsoever.

According to the invention, the layer of adhesive material 40 can be a layer of a hot melt adhesive or a premixed bi-component adhesive or a reactive single-component.

According to the invention, the layer of adhesive material 40 can be applied on one or both panels 20, 30 to be joined, and in particular on the opposite surfaces.

According to a preferred embodiment of the invention, the application of the layer of adhesive material 40 occurs independently from the installation of the skylight and in particular distant in terms of time from the moment of providing the joining between the panels 20, 30.

The state of adhesive material is subsequently reactivated by heat, when performing the joining between the panels 20, 30, for example through heating devices such as ultrasonic, microwaves, infrareds or heat radiating devices or the like adapted to generate targeted and controlled heating/radiation of the adhesive surface.

The layer of adhesive material 40 can be applied on one or both panels 20, 30 in different manners, depending on the type of adhesive material. In case of hot melt adhesives, the latter can be applied on the surface of the panel 20, 30 through co-extrusion of a layer of hot melt adhesive or through extrusion in separate units, i.e. non-simultaneous, in the head. They can also be provided through a technique referred to as "roller transfer" or through a knife system, through a spray system or through dosage nozzles with the final part being paddle-shaped, circular-shaped or another geometric function. Excluding co-extrusion only, such techniques can also be used for applying the reactive single-component adhesive.

The premixed two-component adhesives can instead be applied through deposition by spreading or deposition using nozzles, knife or a spray system.

Co-extrusion or extrusion through separate units of a hot melt adhesive on the panel 20, 30 can be obtained through a conventional spreading system with flat head, which allows distributing a uniform layer of hot melt adhesive on at least one of the opposite surfaces of the panels 20, 30 forming the skylight 10. The adhesive layer 40 made of hot melt material can be applied both in form of continuous and discontinuous surface, for example with lines in specific zones, such as the substantially flat bases 23 of the fretted top panels 20 or the cusps 34 of the knurled profile of the bottom alveolar panel 30.

This method of discontinuous co-extrusion or extrusion allows saving material through the specific application in the areas in which gluing between opposite surfaces is required and necessary.

As mentioned, the application of a lining made of a hot melt adhesive on at least one of the opposite surfaces of the panels 20, 30 forming the skylight 10 can also be provided through a conventional "roller transfer" application system or through a knife system, a nozzles system or a spray system. In a manner analogous to the one described for co-extrusion, also the layer of adhesive 40 made of hot melt material applied using these systems can be carried out discontinuously and limited to the gluing zones.

The application of one of the adhesives mentioned above on the cusps 34 of the knurled surface can be carried out using a flat head spreading device as mentioned above or through a roller transfer system.

The hot melt adhesives that can be used for providing the layer of adhesive material 40 should meet the following requirements:

a) the chemical composition and the application temperature of the adhesive should be such not to damage the polycarbonate of the panels, for example causing the deformation of the panel due to the heat or corrosion of the surface on which it is applied;

b) upon application, the adhesive should guarantee suitable transparency in the gluing areas;

c) the structure of the applied adhesive should remain as unaltered as possible over time, guaranteeing suitable capacity and life of adhesion;

d) the adhesive should not become opaque and/or turn yellowish;

e) when performing the joining between the top fretted panel and bottom alveolar panel, the hot melt adhesive should be capable of being reactivated by heat, i.e. it should recover the adhesive characteristics thereof, by heating at a mild temperature (not exceeding 120° C.), so as not to damage the top fretted panel 20 and/or the outer protection layer 24 against UV rays possibly present on the surface thereof.

The main types of hot melt adhesives meeting the previously mentioned requirements are the polyurethane-based adhesives, acrylic-based adhesives or the new generation Amorphous Poly-alpha-olefins (APAO) or Amorphous Polyolefins (APO) or chemically equivalent adhesives.

The polyurethane-based adhesives comprise thermal adhesive polyurethane polymers obtained by reaction between aliphatic isocyanates, such as hexamethylene diisocyanate (HDI) and isophorone diisocyanates (IPDI), and polyester polyols, polyether polyols, caprolactone polymers or polycarbonate nature.

The acrylic-based adhesives comprise the mixture of polymers, copolymers or thermo polymers with acrylic functions. The formulations of the acrylic-based adhesive may also comprise:

1) adhesive components ("tackifiers"), such as hydrogenated hydrocarbon resins, terpen-phenolic resins and polyterpene resins;

2) structuring polymers such as polymethylmethacrylate (PMMA), methacrylate-butadiene-styrene (MBS) copolymer, styrene-isoprene-styrene (SIS) copolymer and styrene-butadiene-styrene copolymer.

In case of use of premixed two-component adhesives, the application on at least one of the opposite surfaces of the panels 20, 30 forming the skylight 10 can be obtained through spreading, using nozzles for applying the adhesive or "roller transfer" application system. The two-component adhesive is premixed before being introduced into the means for applying the adhesive.

Preferably, a two-component adhesive obtained by mixing OH-terminated aliphatic urethane prepolymers in aqueous dispersion and blocked aliphatic isocyanates can be used as premixed bi-component adhesive. The aqueous dispersion obtained from the above-mentioned mixing is applied on the surface of at least one of the panels and dried subsequently, for example using hot air, heat pump (dehumidifier), vacuum or such systems combined. Drying can be carried out in the production line placing the panel in a heated aerated tunnel.

In case of use of a premixed bi-component adhesive, at the end of the application of the adhesive on the panel and the subsequent drying, it is preferable to apply a protective film of polyolefin nature (PP, PE, etc) thereon so as to allow storing the panel as obtained in a warehouse over a long period of time.

Hot reactivation of such mixture at a temperature between 60 and 160° C. (through radiation with ultrasonic, microwaves, infrareds or heat radiating devices or equivalent devices) shall allow activating the blocked isocyanates, triggering the polymerisation reaction between a prepolymer and an isocyanate. The polymerisation reaction gives rise to the adhesive material.

Alternatively, a two-component adhesive obtained by mixing an epoxy resin and an amine catalyst could also be used. As known to a man skilled in the art, suitably selecting the type of epoxy resin and the amine catalyst allows controlling the time required to complete the assembly of the components. In such case, the components to be assembled shall be glued within the predefined time limit, which may range from few minutes to a few hours. This method of assembly does not allow creating an intermediate storage of the preassembled panels before assembly.

Analogously, the use of a reactive single-component adhesive, such as hygro-reactive polyurethane, i.e. an isocyanate-terminated polyurethane with non-blocked isocyanate, does not allow storing and requires proceeding to assembling the components within a predefined period of time.

The same assembly technique which provides for preparing the surface of an extruded panel through co-extrusion, for example of a lining layer which confers protection against UV rays, and a subsequent co-extrusion of a hot melt adhesive, or spreading the two-component adhesive, to be hot reactivated when using, can also be used for all the needs for joining the lateral profiles 100 to alveolar panels 30 with a layer of adhesive material 40, as shown by way of example in FIG. 5.

The skylight to be integrated in a covering structure made of insulated sheets subject of the present invention has such advantage that it can be integrated in the covering structure and combined with insulated panels made up of sheets and polyurethane foam or by sheet coupled with insulating mattresses.

An efficient support and a suitable connection between the parts is advantageously attained due to the lateral and head surmounting between the skylight and insulated panel, which is obtained using the same and complementary geometric configuration. This allows guaranteeing efficient heat insulation and a perfect sealing against water.

Furthermore, the skylight according to the invention can be obtained maintaining maximum transparency, equivalent to that of single panels, so as to serve the function of a light point.

Furthermore, all that has been described above advantageously allows the separate storage of the alveolar panels and fretted panels, which may be easily glued subsequently after shaping during the operation.

The skylight to be integrated in a covering structure made of insulated sheets, according to the invention, can also be obtained as units different from extrusion, i.e. be made up of a plurality of alveolar panels and fretted panels, thus allowing attaining maximum flexibility for the size, number and type of section.

The skylight to be integrated in a covering structure made of insulated sheets thus conceived is susceptible to various modifications and variants, all falling within the scope of the invention; furthermore, all the details can be replaced by technically equivalent elements. In practice, the materials used, as well as the dimensions thereof, may vary according to the technical requirements.

The invention claimed is:

1. A skylight to be integrated in a covering structure made of insulated sheets, comprising at least one top fretted transparent panel (20) having a substantially flat base (23), said at least one top fretted transparent panel (20) being extruded from plastic material and at least one bottom transparent alveolar panel (30) having a top surface and a bottom surface extruded from plastic material, firmly integrally joined together by interposing a layer of adhesive material (40) wherein said layer of adhesive material (40) is prearranged on a bottom surface of said at least one top fretted transparent panel (20) and on the top surface of said at least one bottom transparent alveolar panel (30) facing the at least one top fretted transparent panel (20), said at least one bottom transparent alveolar panel (30) comprising a closed cell multi-alveolar panel, said at least one bottom transparent alveolar panel (30) comprising at opposite ends, in the direction of the width, respectively a recessed seat (32) and a projecting edge (33), for lateral coupling with an adjacent at least one bottom transparent alveolar panel (30), said at least one top fretted transparent panel (20) comprising a portion projecting transversely beyond said at least one bottom transparent alveolar panel (30) for transverse coupling by superimposing with an adjacent at least one top fretted transparent panel (20) said at least one bottom transparent alveolar panel (30) comprising knurling on the top surface facing said at least one top fretted transparent panel (20), said knurling comprising a succession of triangular-shaped cusps havine tips (34), said layer of adhesive material (40) being discontinuous and arranged between the tips of said triangular-shaped cusps (34) of said knurling and said substantially flat base (23) of said at least one top fretted transparent panel.

2. The skylight according to claim 1, wherein said at least one said top fretted panel (20) is made of polycarbonate (PC) or polymethylmethacrylate (PMMA) and said at Least one bottom alveolar panel (30) is made of transparent polycarbonate (PC).

3. The skylight according to claim 2, wherein said at least one top fretted transparent panel and said at least one bottom transparent alveolar panel made of polycarbonate are provided with a surface layer (41), made of a polar polymer material selected from the group consisting of polyesters, polyurethanes, caprolactone polymers, acrylic polymers, acrylonitrile and silane.

4. The skylight according to claim 3, wherein the polyester is polyethylene terephthalate.

5. The skylight according to claim 1, wherein said layer of adhesive material (40) is hot re-activated adhesive.

6. The skylight according to claim 5, wherein said layer of adhesive material (40) is selected from the group consisting of hot melt adhesive, a premixed bi-component adhesive and reactive single-component adhesive.

* * * * *